US005706842A

United States Patent [19]

Caimi et al.

[11] Patent Number: 5,706,842

[45] Date of Patent: Jan. 13, 1998

[54] BALANCED ROTATING SPRAY TANK AND PIPE CLEANING AND CLEANLINESS VERIFICATION SYSTEM

[75] Inventors: Raoul E. B. Caimi, Titusville; Eric A. Thaxton, Merritt Island, both of Fla.

[73] Assignee: The United States of America as represented by the Administrator of the National Aeronautics and Space Administration, Washington, D.C.

[21] Appl. No.: 412,674

[22] Filed: Mar. 29, 1995

[51] Int. Cl.[6] ..... B08B 3/02

[52] U.S. Cl. ..... 134/113; 134/102.2; 134/167 R; 134/181; 261/DIG. 78

[58] Field of Search ..... 134/172, 180, 134/181, 113, 102.2, 167 R, 102.1, 168 C, 168 R, 167 C; 261/78.2, DIG. 78; 239/346; 417/172, 171

[56] References Cited

U.S. PATENT DOCUMENTS

| | | | |
|---|---|---|---|
| 2,201,080 | 5/1940 | Clark . | |
| 2,244,159 | 6/1941 | Hunter . | |
| 2,366,969 | 1/1945 | Kiggins . | |
| 2,726,666 | 12/1955 | Oxford | 134/181 |
| 2,904,053 | 1/1959 | Henzel . | |
| 3,188,238 | 6/1965 | Lyon | 134/102.2 |
| 3,276,694 | 10/1966 | Alexander | 134/181 |
| 3,444,869 | 5/1969 | Guignon | 134/181 |
| 3,472,451 | 10/1969 | Orem et al. | 134/167 R |
| 3,580,511 | 5/1971 | Hammelman et al. | 134/167 R |
| 3,696,825 | 10/1972 | Guignon et al. | 134/167 R |
| 3,744,723 | 7/1973 | Davis . | |
| 4,059,123 | 11/1977 | Bartos et al. . | |
| 4,141,754 | 2/1979 | Frauenfeld . | |
| 4,206,313 | 6/1980 | Cavoretto . | |
| 4,208,219 | 6/1980 | Etscheid . | |
| 4,237,565 | 12/1980 | Torita et al. . | |
| 4,545,157 | 10/1985 | Saurwein . | |
| 4,677,997 | 7/1987 | Strauss . | |
| 4,690,333 | 9/1987 | Johansson . | |
| 4,715,538 | 12/1987 | Lingnau . | |
| 4,787,404 | 11/1988 | Klosterman et al. | 134/102.2 |
| 4,796,042 | 1/1989 | Mappin et al. | 134/113 |
| 4,806,171 | 2/1989 | Whitlock et al. . | |
| 4,826,084 | 5/1989 | Wallace . | |
| 4,909,325 | 3/1990 | Hopmann . | |
| 4,919,853 | 4/1990 | Alvarez et al. . | |
| 4,923,021 | 5/1990 | Courmier et al. | 134/167 R |
| 4,930,531 | 6/1990 | Ballu . | |
| 5,029,594 | 7/1991 | Pierce, Jr. . | |
| 5,044,552 | 9/1991 | Becker et al. . | |
| 5,125,126 | 6/1992 | Bonnant . | |
| 5,125,425 | 6/1992 | Folts et al. . | |
| 5,252,298 | 10/1993 | Jones . | |
| 5,279,357 | 1/1994 | Kennon et al. . | |
| 5,322,571 | 6/1994 | Plummer et al. . | |
| 5,336,356 | 8/1994 | Ban et al. . | |
| 5,366,562 | 11/1994 | Schwarze et al. | 134/102.2 |

FOREIGN PATENT DOCUMENTS 2075369 11/1981 United Kingdom .

*Primary Examiner*—Frankie L. Stinson
*Attorney, Agent, or Firm*—Beth A. Vrioni; John G. Mannix

[57] ABSTRACT

A system for cleaning and verifying the cleanliness of the interior surfaces of hollow items, such as small bottles, tanks, pipes and tubes, employs a rotating spray head for supplying a gas-liquid cleaning mixture to the item's surface at a supersonic velocity. The spray head incorporates a plurality of nozzles having diverging cross sections so that the incoming gas-liquid mixture is first converged within the spray head and then diverged through the nozzles, thereby accelerating the mixture to a supersonic velocity. In the preferred embodiment, three nozzles are employed; one forwardly facing nozzle at the end of the spray head and two oppositely facing angled nozzles exiting on opposite sides of the spray head which balance each other, and therefore impart no net side load on the spray head. A drive mechanism is provided to rotate the spray head and at the same time move the head back and forth within the item to be cleaned. The drive mechanism acts on a long metal tube to which the spray head is fixed, and thus no moving parts are exposed to the interior surfaces of the items to be cleaned, thereby reducing the risk of contamination.

22 Claims, 2 Drawing Sheets

BALANCED ROTATING SPRAY TANK AND PIPE CLEANING AND CLEANLINESS VERIFICATION SYSTEM

The present invention was made by employees of the United States Government and may be manufactured and used by or for the government for government purposes without the payment of any royalties thereon or therefor.

BACKGROUND OF THE INVENTION

The present invention relates in general to a system for cleaning interior surfaces of small tanks, bottles, pipes and tubes which employs a balanced rotating spray nozzle for supplying a two-phase gas-solvent mixture at a supersonic velocity. The system can also be used for cleanliness verification by replacing the solvent with water, and monitoring the contaminant level of the waste water.

It is often necessary in industry to clean and verify the cleanliness of hollow items including small tanks and bottles, and small diameter pipes and tubes. For example, gas bottles for supplying gas to a welding torch must be periodically cleaned to avoid contamination of the gas stored therein. These bottles typically have a relatively large interior diameter, however, have a relatively small diameter opening for dispensing the gas, this diameter typically being on the order of approximately 1 inch. This design makes it very difficult to clean the interior of the bottle, especially in the areas adjacent its neck portion.

A number of techniques have been employed in the past for cleaning the interior surfaces of these types of items including flushing the items with solvents and spraying them with high pressure rotating liquid nozzles. Although these are generally effective methods for insuring that all of the interior surfaces, including corners and neck portions, of a small tank or similar item are sufficiently cleaned, both of these methods have drawbacks. In particular, solvent flush methods require large volumes of chemicals to dissolve the contaminants which is undesirable both from an economic and environmental standpoint. High pressure liquid sprays, although requiring less solvent than solvent flush methods, still require undesirably high volumes of solvent. In view of this, the need clearly exists for an effective cleaning system which requires neither strong environmentally unfriendly solvents, nor high volumes of cleaning liquids for cleaning problem items, such as the interiors of small tanks and pipes.

SUMMARY OF THE INVENTION

The present invention seeks to fulfill this need by providing an improved tank and pipe cleaning and cleanliness verification system which employs a rotating spray head for supplying a gas-liquid mixture to the item to be treated. The spray head includes a plurality of spray nozzles, each of which is specially designed to accelerate a two-phase gas-liquid cleaning mixture to a supersonic velocity. Preferably, three of the spray nozzles are provided, one at the tip of the spray head which is aimed directly forward, and the other two of which are angled away from the longitudinal axis of the spray head and exit on opposite sides thereof. The first of the angled nozzles is aimed in a generally forward direction, while the second angled nozzle is aimed in a generally rearward direction, but is parallel to the first angled nozzle. Since these two angled nozzles are on opposite sides of the spray head, and are parallel with each other, there is no net force imparted by them on the spray head during operation; thus, the spray head is balanced.

Preferably, the spray head is disposed on the end of an extension tube which in turn is both rotatable and translatable along its longitudinal axis by means of a drive mechanism. A threaded nut mounted on a stationary frame is threaded on and supports the extension tube, and is positioned adjacent the entrance of a tank or pipe to be treated during operation. With this arrangement, no bearings or other moving parts are positioned inside the pipe or tank being treated, thereby eliminating these potential sources of contamination. Rotation of the extension tube causes simultaneous translational movement of the same as the tube threads advance through the stationary nut.

To minimize cleaning fluid consumption without compromising cleaning efficiency, the system employs a two-phase gas and liquid cleaning mixture that is supplied at a low pressure to the spray head. To provide the required cleaning action, the spray head's nozzles are specially designed to accelerate the gas-liquid mixture to a supersonic velocity. In particular, each of the nozzles has a diverging cross section with a narrow throat that intersects a central passage in the spray head. The intersection between the two angled nozzles and the central passage is located where the gas-liquid jet converges due to the curved shape of the central passage. This convergence of the gas-liquid jet, followed by divergence of the same through the nozzles, results in acceleration of the jet to a supersonic velocity. The mechanical action of the supersonic jet thereby efficiently removes all contaminants on the interior surfaces of the tank or pipe to be cleaned, and does so without use of either a high volume liquid supply, or strong solvents.

Alternatively, the system can also be employed for cleanliness verification. This is achieved simply by replacing the cleaning liquid with plain water, and providing a means for collecting and analyzing the waste water after it has been sprayed onto the item. If the contaminant level of the waste water is below a prescribed level, cleanliness of the item is verified.

BRIEF DESCRIPTION OF THE DRAWINGS

The features and advantages of the present invention will become more apparent from the following detailed description of a preferred embodiment thereof, taken in conjunction with the accompanying drawings, in which.

DETAILED DESCRIPTION OF THE PREFERRED EMBODIMENT

Figure 1:
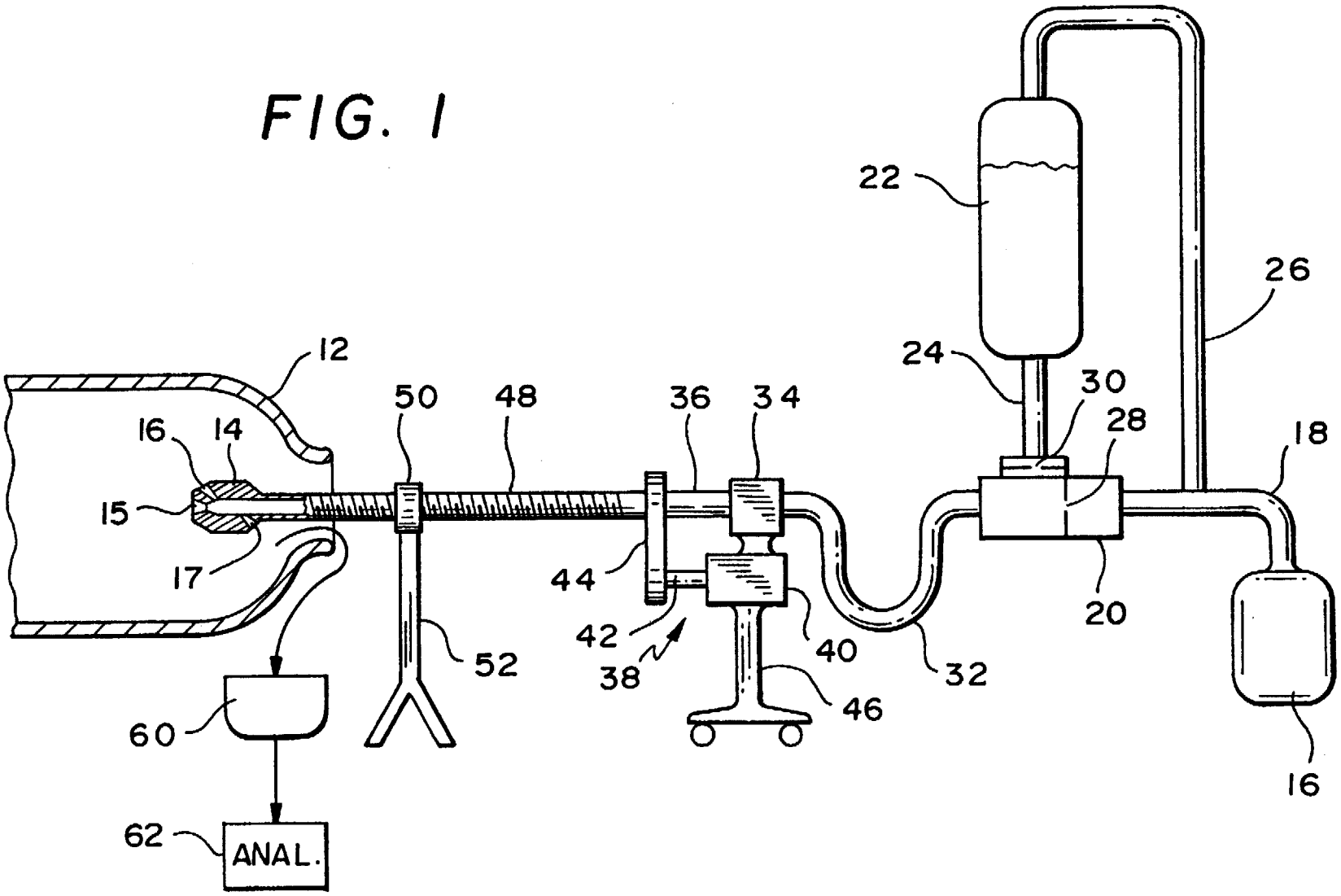
FIG. 1 is a schematic illustration of a tank and pipe cleaning and cleanliness verification system constructed in accordance with the preferred embodiment.

Turning now to a more detailed consideration of a preferred embodiment of the present invention, FIG. 1 illustrates a cleaning system 10 which is particularly suited for cleaning the interior surfaces of a small tank or bottle 12. The system 10 employs a two-phase gas and liquid cleaning mixture which is supplied at low pressure to a cleaning head 14 having a plurality of diverging nozzles 15, 16 and 17 disposed therein (to be discussed in greater detail below in conjunction with FIG. 2).

To form the two-phase cleaning mixture, a gas supply tank for supplying a suitable gas, such as $N_2$ or air for example, is connected via a supply tube 18 to a mixing valve 20, and supplies the gas at a pressure of a few hundred psi, more or less. A liquid tank 22 supplies a cleaning liquid, preferably a dilute mixture of water and a mild solvent or detergent, through a tube 24 to the mixing valve 20. A third tube 26 branches off of the gas supply tube 18 and is connected to the inlet end of the liquid tank 22 so that the pressure of the inert gas from the gas supply tank 16 acts to discharge the liquid. The liquid is preferably supplied at a fairly low flow rate, such as for example, 30 ml/min. The mixing valve 20 includes a gas orifice 28 and a liquid orifice 30 for accurately metering the supplied gas and liquid to obtain the desired mixture.

A flexible hose 32 is connected between the outlet of the mixing valve 20 and a first side of a rotating union 34. A second side of the rotating union 34 is connected to a first end of a metal (preferably stainless steel) extension tube 36, a second end of which is fixedly attached to the spray head 14. The rotating union 34 permits relative rotation of the metal tube 36 with respect to the flexible hose 32.

A drive mechanism indicated generally as 38 is provided to cause both rotational and translational movement of the metal tube 36 and the spray head 14. The drive mechanism 38 includes a reversible drive motor 40 having an output shaft 42 which drives a belt 44 through a pulley. The belt 44 in turn drives a pulley which is rigidly attached to the metal tube 36.

The drive motor 40 and rotating union 34 are supported by a wheeled support frame 46 which permits translational movement of these elements. To provide this translational movement, the metal tube 36 has a threaded exterior portion 48 which engages a threaded nut 50 that is mounted on a fixed support frame 52. As the metal tube 36 rotates, the threaded portion 48 engaging the nut 50 causes the metal rod 36 to move along its longitudinal axis. In this manner, the spray head 14 can be caused to reciprocate within the bottle 12 to be cleaned as it is rotated by first actuating the drive motor 40 in the forward direction, and then in the reverse direction. It should be noted that the flexible hose 32 is provided with enough slack to accommodate the required translational motion of the metal tube within the item to be cleaned.

To verify cleanliness of the tank or bottle 12, a waste water catch pan 60 is provided which collects the waste water from the tank or bottle 12. A contaminant analyzer 62 of any suitable conventional construction is then employed to determine the contaminant level of the waste water, and this level is directly related to the cleanliness level of the tank or bottle 12.

Figure 2:
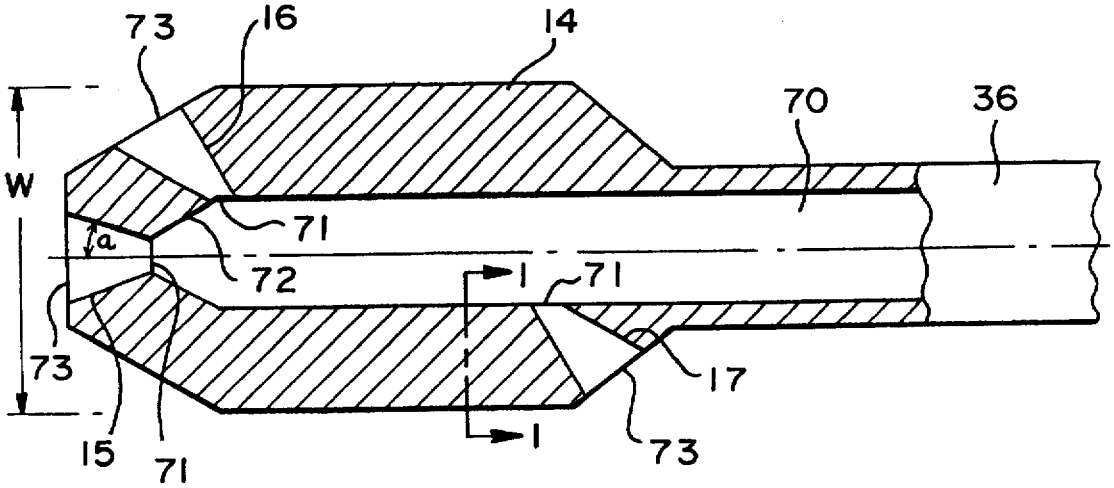
FIG. 2 is a cross sectional schematic illustration of the preferred embodiment of the spray head used with the system of FIG. 1.
Figure 3:
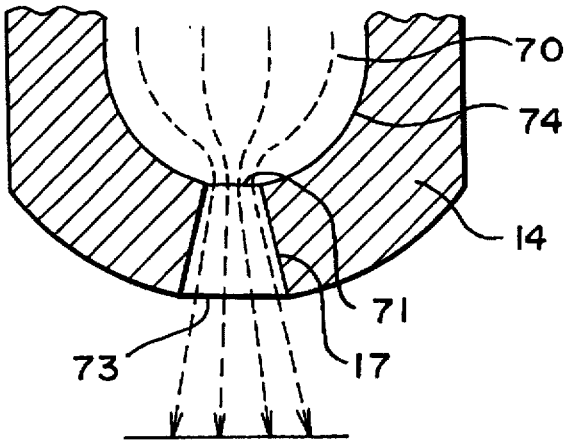
FIG. 3 is a partial cross sectional illustration of the spray head taken along line 1—1 of FIG. 2.

Turning now to FIGS. 2 and 3, the details of the spray head 14 are more clearly illustrated. The spray head 14 and its nozzles 15–17 are specially designed to achieve acceleration of the gas-liquid mixture to a supersonic velocity by using the concepts set forth in Applicants'copending application U.S. Ser. No. 08/116,593, filed Aug. 30, 1993 and entitled "Gas-Liquid Supersonic Cleaning and Cleaning Verification Spray System". That application discloses a cleaning system which, like the present invention, incorporates nozzles which accelerate a gas-liquid mixture to a supersonic velocity. This is achieved by providing the nozzles with a converging-diverging cross section. It is particularly suited for accelerating a compressible gas-liquid mixture to a supersonic velocity. The spray head 14 of the subject invention has a centrally disposed passage 70 which is in communication with the inlet or throat ends 71 of the forward facing nozzle 15 and the first and second angled nozzles 16 and 17. As illustrated, the passage 70 has a tapered end portion 72 which serves to converge the gas-liquid mixture into the inlet or throat end 71 of the forward facing nozzle 15. This converging-diverging arrangement results in acceleration of the gas-liquid mixture to a supersonic velocity through the forward facing nozzle 15. The angle "a" between the longitudinal axis and the walls of the diverging nozzles 15–17 is preferably in the range of approximately 12°–18° to insure that the gas-liquid flow will not detach from the nozzle surface, but at the same time minimize energy absorbing frictional forces that would prevent the necessary acceleration of the gas-liquid mixture.

Each of the nozzles 15–17 also has an outlet or exit 73 which, because of the diverging shape of the nozzles 15–17, has a substantially larger area than that of the throat or inlet 71. Applicants have derived equations relating the resulting velocity of the gas-liquid mixture exiting the nozzles 15–17 to the ratio of the outlet area divided by the throat or inlet area of each of the nozzles. In particular, the experiments have shown that with a nozzle length of between ¼ to ½ inch, a throat or inlet diameter of 3/32 inches, an outlet or exit diameter of 7/32 inches, and a resulting exit/throat area ratio of approximately 5.44, acceleration of the gas-liquid mixture to mach 3 can be achieved.

The overall width w of the spray head 14 must be kept as small as possible so that the spray head 14 can be inserted through narrow openings of small bottles, tanks, pipes and tubes. For example, the typical aperture size of a conventional welding gas bottle is 1 inch so that the width w must be less than 1 inch. To accommodate this limitation, while at the same time providing the necessary converging-diverging arrangement of the angled nozzle 16 and 17, they are preferably formed in the spray head 14 with longitudinal axes that make a 45° angle with the longitudinal axis of the central passage 70. In addition, as illustrated in FIG. 3, the necessary convergence for the angled nozzles 16 and 17 is provided by the curved geometry of the central passage 70 which forms a converging section 74 that leads into the throats 71 of the two angled nozzles 16 and 17. The converging section 74 causes the gas-liquid mixture to converge as it enters each of the two angled nozzles 16 and 17, and then it diverges as it exits the two nozzles. Although this is not as efficient for accelerating the mixture as is a traditional converging-diverging nozzle, such as is disclosed in Applicants'previously mentioned copending application, its use is preferable with the angled nozzles 16 and 17 to keep their overall lengths, and therefore the overall width of the spray head 14, to a minimum.

In operation, once the spray head 14 is inserted in the bottle, tank, pipe or tube to be cleaned, the motor 40 is actuated, and the spray head 14 is caused to rotate and simultaneously move slowly along the longitudinal axis of the bottle or tank. The reduction ratios of the various drive elements in the drive mechanism 38 are chosen so that the translational and rotational speeds are appropriately matched to provide the most efficient cleaning action. In the preferred embodiment of the invention, the rotational speed of the spray head 14 is chosen to be fairly high, for example, 100 rpm, while the translational speed is chosen to be fairly slow, on the order of approximately 50 inches per minute. Once the spray head 14 has been extended fully within the hollow item to be cleaned, the motor 40 is reversed so that the spray head 14 and tube 36 will be withdrawn slowly from the item.

If the cleanliness of the item is to be verified, the operation of the system up to this point is the same, with the exception that water is employed in place of the cleaning liquid. Also, once the interior of the hollow item has been thoroughly sprayed, the waste water is collected from within the item by the catch pan 60 and analyzed by the analyzer 62 for contaminant levels.

In summary, the present invention provides a system for cleaning and verifying the cleanliness of the interior surfaces of hollow items having small inlet diameters which provides a number of advantages over prior art systems and methods. In particular, the design of the spray head provides the ability to accelerate the gas-liquid mixture to a supersonic velocity without making the size of the spray head too large for the desired applications. The balanced arrangement of the two angled nozzles also eliminates excessive stresses on the nut 50 and the bearings contained in the rotating union 34 and insures that all interior surfaces of the item being cleaned will be thoroughly covered. Since the spray head is formed integrally with the metal extension tube 36, all rotating connections and bearing surfaces are maintained outside of the item being cleaned, thereby eliminating these potential sources of contamination. Finally, the use of the rotational and translational motion drive mechanism provides a convenient means for insuring that the items are thoroughly cleaned.

Although the present invention has been described in terms of a preferred embodiment, it will be understood that numerous other modifications and variations could be made thereto without departing from the scope of the invention as set forth in the following claims.

What is claimed is:

1. A system for cleaning interior surfaces of hollow items including bottles, tanks, pipes and tubes comprising:

a spray head containing a plurality of diverging cross section spray nozzles, each said spray nozzle having an inlet and an outlet with the inlet having an area smaller than the outlet area;

means for supplying a gas-liquid mixture to said spray head; and means for rotating said spray head, whereby the spray nozzles accelerate the gas-liquid mixture to a supersonic velocity at the outlet of the nozzles and impinge the mixture on the interior surfaces of a hollow item.

2. The system of claim 1 wherein said plurality of diverging cross section spray nozzles includes first and second balanced, oppositely facing nozzles having longitudinal axes parallel to one another, but disposed at an angle relative to a longitudinal axis of said spray head, said first and second nozzles having outlet ends disposed on first and second opposite side walls of said spray head.

3. The system of claim 2, wherein said first nozzle is generally forwardly facing relative to a front end of said spray head, and said second nozzle is generally rearwardly facing relative to the front end of said nozzle, whereby said second nozzle is particularly suited for spraying inlet areas of a hollow item when said spray head is positioned therein.

4. The system of claim 3, further including a third forwardly facing nozzle having an outlet end disposed at said front end of said spray head.

5. The system of claim 2 wherein the spray head has a tubular passage in communication with the inlets of the nozzles, whereby said mixture is converged by the tubular passage prior to entering the nozzle inlets followed by divergence in said spray nozzles resulting in acceleration of said gas-liquid mixture to a supersonic velocity.

6. The system of claim 5, further comprising:

a third forwardly facing nozzle having an outlet end disposed at a front end of said spray head; and a tapered end of said passage at said front end of the spray head in communication with the inlet of said third nozzle, whereby said mixture is converged by the tapered end prior to entering the inlet of the third nozzle followed by divergence in said third spray nozzle resulting in acceleration of said gas-liquid mixture to a supersonic velocity.

7. The system of claim 1, wherein said spray head further includes means for converging said gas-liquid mixture prior to entering the inlets of said spray nozzles, whereby convergence of said gas-liquid mixture followed by divergence in said spray nozzles results in acceleration of said gas-liquid mixture to a supersonic velocity.

8. The system of claim 7 wherein the converging means comprises said spray head having a tubular passage in communication with the nozzle inlets.

9. The system of claim 1, further including:

an extension tube having a first end fixedly attached to an inlet end of said spray head, and a second end rotatably connected to said means for supplying said gas-liquid mixture to said spray head.

10. The system of claim 9, further including means for supporting said spray head and at least a portion of said extension tube within a hollow item to be sprayed.

11. The system of claim 1, wherein said means for rotating said spray head further includes means for simultaneously moving said spray head back and forth along a longitudinal axis of a hollow item to be sprayed.

12. The system of claim 11, wherein said means for rotating said spray head and for simultaneously moving said spray head back and forth comprises:

a reversible drive motor having a rotatable output shaft;

drive means connected between said output shaft and said extension tube;

a threaded portion on an exterior surface of said extension tube; and a stationary threaded nut mounted on said threaded portion;

whereby, rotation of said drive motor in a first direction causes rotation of said spray head and said extension tube in a first direction, and translation of said spray head in a first direction, and rotation of said drive motor in a second, opposite direction, causes rotation of said spray head in a second, opposite direction, and translation of said spray head in a second, opposite direction.

13. The system of claim 1, further comprising means for collecting waste liquid from within a hollow item after it has been sprayed, and means for analyzing the waste liquid to determine its contaminant level, and thereby determine the cleanliness of the hollow item.

14. The system of claim 1 wherein the liquid is supplied at a low flow rate.

15. A system for cleaning and verifying the cleanliness of interior surfaces of hollow items including bottles, tanks, pipes and tubes comprising:

a spray head containing first and second balanced, oppositely facing diverging cross section spray nozzles for accelerating a gas-liquid cleaning mixture to a supersonic velocity and impinging the same on the interior surfaces of a hollow item, said balanced, oppositely facing nozzles having longitudinal axes parallel to one another, but disposed at an angle relative to a longitudinal axis of said spray head, and having outlet ends disposed on first and second opposite side walls of said spray head, each said spray nozzle having an inlet and an outlet with the inlet having an area smaller than the outlet area, said spray head further including means for converging said gas-liquid mixture prior to entering the inlets of said spray nozzles, whereby convergence of said gas-liquid mixture followed by divergence in said spray nozzles results in acceleration of said gas-liquid mixture to a supersonic velocity at the outlet of the nozzle;

means for supplying a gas-liquid mixture to said spray head;

an extension tube having a first end fixedly attached to an inlet end of said spray head, and a second end rotatably connected to said means for supplying said gas-liquid mixture to said spray head; and means for simultaneously rotating and moving said spray head back and forth along a longitudinal axis of a hollow item to be sprayed.

16. The system of claim 15, wherein said spray head further includes a third, forwardly facing diverging cross section spray nozzle having an outlet end disposed at a front end of said spray head.

17. The system of claim 15, further including means for supporting said spray head and at least a portion of said extension tube within a hollow item to be sprayed.

18. The cleaning system of claim 15, wherein said means for simultaneously rotating and moving said spray head back and forth comprises:

a reversible drive motor having a rotatable output shaft;

drive means connected between said output shaft and said extension tube;

a threaded portion on an exterior surface of said extension tube; and a stationary threaded nut mounted on said threaded portion;

whereby, rotation of said drive motor in a first direction causes rotation of said spray head and said extension tube in a first direction, and translation of said spray head in a first direction, and rotation of said drive motor in a second, opposite direction, causes rotation of said spray head in a second, opposite direction, and translation of said spray head in a second, opposite direction.

19. The system of claim 15, wherein said first nozzle is generally forwardly facing relative to a front end of said spray head, and said second nozzle is generally rearwardly facing relative to the front end of said nozzle, whereby said second nozzle is particularly suited for spraying inlet areas of a hollow item when said spray head is positioned therein.

20. The system of claim 15, further comprising means for collecting waste liquid from within a hollow item after it has been sprayed, and means for analyzing the waste liquid to determine its contaminant level, and thereby determine the cleanliness of the hollow item.

21. The system of claim 15 wherein the converging means comprises said spray head having a tubular passage in communication with the nozzle inlets.

22. The system of claim 21, further comprising:

a third forwardly facing nozzle having an outlet end disposed at a front end of said spray head; and a tapered end of said passage at said front end of the spray head in communication with the inlet of said third nozzle, whereby said mixture is converged by the tapered end prior to entering the inlet of the third nozzle followed by divergence in said third spray nozzle resulting in acceleration of said gas-liquid mixture to a supersonic velocity.

* * * * *